US005729814A

United States Patent [19]

Suzuki et al.

[11] Patent Number: 5,729,814

[45] Date of Patent: Mar. 17, 1998

[54] HEATING ROLLER FOR FIXATION AND METHOD FOR FABRICATING SAME

[75] Inventors: Makoto Suzuki; Takemi Yamamoto, both of Nagoya, Japan

[73] Assignee: Brother Kogyo Kabushiki Kaisha, Nagoya, Japan

[21] Appl. No.: 644,262

[22] Filed: May 10, 1996

[30] Foreign Application Priority Data

May 12, 1995 [JP] Japan ..... 7-114413

[51] Int. Cl.[6] ..... G03G 15/20

[52] U.S. Cl. ..... 399/333

[58] Field of Search ..... 399/328, 330, 399/333, 336; 219/470, 471

[56] References Cited

U.S. PATENT DOCUMENTS 3,624,353 11/1971 Bjorklund ..... 219/470

4,724,303 2/1988 Martin et al. ..... 399/328

4,745,431 5/1988 Kogure et al. ..... 399/333 X 4,883,941 11/1989 Martin et al. ..... 219/216

FOREIGN PATENT DOCUMENTS

A-62-279378 4/1987 Japan .

*Primary Examiner*—Fred L. Braun

*Attorney, Agent, or Firm*—Oliff & Berridge, P.L.C.

[57] ABSTRACT

A resistance heating element member formed with a resistor member on a polyimide film or resin sheet is fixed to the inner circumferential surface of a roller drum by blow-molding with a heat-resistant resin member. The resistor member includes a metal foil and meanders several times in a predetermined belt-like or serpentine pattern, and electrically contacts slide electrodes arranged on the roller at each side of the roller.

17 Claims, 5 Drawing Sheets

HEATING ROLLER FOR FIXATION AND METHOD FOR FABRICATING SAME

BACKGROUND OF THE INVENTION

1. Field of the Invention

The present invention relates to a heating roller for fixating by heating toner onto a medium to be recorded with an image.

2. Description of Related Art

Conventional toner-based image recording devices such as copiers and printers have a recording assembly, a fixating assembly, and a feeding assembly. Toner is attached by the recording assembly in a form instructed by an image signal onto a recording medium fed by the feeding assembly to be heated by a heating roller for fixation arranged in the feeding assembly for fixation.

For the above-mentioned heating roller for fixation, several types have been proposed in which a resistance heating element is provided such that it reaches a predetermined fixable temperature (130° C. for example) in a short duration of time at fixation, the resistance heating element being powered through an electrode arranged on the roller body for heat generation.

For example, JP-A-62-279378 discloses a roller device for fixation in which a roller body is formed on its external circumferential surface with a deposit prevention layer for preventing the deposit of toner on a recording medium, while the roller body is formed on its inner circumferential surface with a resistance heating element layer of a uniform thickness, the roller body being further arranged on each end with a power supply member having a ring brush that contacts the resistance heating element layer from inside the roller body, whereby a gap between the pair of power supply members is adjusted through a drive assembly to efficiently heat the roller only at portions corresponding to a width of the recording medium to be recorded with an image.

In the disclosed roller device for fixation, however, the roller body is formed on its inner circumferential surface with an insulating layer for insulating the resistance heating element layer, and the resistance heating element is fixed on the insulating layer on its inner circumferential surface. This arrangement requires complicated formation of the insulating layer and fixing of the resistance heating element, thus complicating the driving assembly for moving the pair of power supply members, thereby increasing fabrication cost and the size of the fixation assembly.

Meanwhile, generally, both ends of the rotationally driven fixation roller are relatively large in heat radiation, making temperatures at these areas lower than that at the center portion of the roller. It is therefore necessary to increase the heat generation at both ends to make substantially uniform the temperature distribution over the roller in its entirety. To meet this requirement, it is necessary to form the roller such that the resistance heating element layer becomes thinner toward both ends or the member is combined with some other material that generates a larger amount of heat than the member. This complicates the fabrication of the resistance heating element layer that makes substantially uniform the temperature distribution over the fixation roller, thereby making the roller costly.

A method has been proposed to solve the above-mentioned problem in which the resistance heating element layer is formed by a belt-shaped resistor member that meanders in a predetermined pattern on the inner circumferential surface of the fixation roller. However, this method requires very complicated and precise formation of the meandering belt-shaped material inside the roller of a relatively small diameter, inevitably taking a lot of time to complete the work.

SUMMARY OF THE INVENTION

To solve the above-mentioned problems, we propose a heating roller for fixation wherein a resistance heating element member is formed by a heat generating sheet having a resistor member formed in a predetermined pattern, the resistance heating element member being fixedly attached with a heat-resistant adhesive onto the roller body on its inner circumferential surface. With this structure, the heat generating sheet is formed thereon with the resistor member formed in a predetermined pattern and the resultant heating generating sheet is simply fixed to the roller body on its inner circumferential surface. This novel arrangement simplifies the fabrication of the fixation roller and permits flexible adjustment of the temperature distribution over the roller.

However, in the above-mentioned prototype roller, the resistance heating element member is fixed to the roller body on its inner circumferential surface by use of a heat-resistant adhesive, so that air bubbles contained in the adhesive and mixed in it during its application grow larger as the roller is heated and cooled repeatedly, thus preventing the heat generated by the resistor member from conducting to the roller body. If the heat does not conduct, it is contained in the resistor member, eventually causing the resistor member to burn itself out.

It is therefore an object of the present invention to overcome the above-mentioned problem by providing a heating roller relatively simple in fabrication, flexibly adjustable in heat distribution, and excellent in durability.

In carrying out the invention and according to one aspect thereof, there is provided a heating roller for fixation having a cylindrical roller and a resistance heating element member to heat toner attached to a recording medium for fixation. The resistance heating element member is formed by a heat-resistant resin sheet externally formed with a heater. The heat-resistant resin sheet is integrally fixed to the roller on its inner circumferential surface by blow-molding another heat-resistant resin.

Further, the heating roller for fixation according to the invention has a cylindrical roller and a resistance heating element member to heat toner attached to a recording medium for fixation. The resistance heating element member is formed by a cylindrical heat-resistant resin externally formed with a heater, and further externally formed with an insulating layer. The resistance heating element member thus formed is integrally fixed inside the roller by blow-molding.

Still further, in the heating roller for fixation according to the invention, the heater may be formed by a belt-shaped resistor member that meanders in a predetermined pattern, both ends of the roller being provided with an electrode formed by the same material as the resistor member, and the electrode is arranged such that it continues on the resistor member.

Yet further, the resistor member of the heating roller for fixation according to the invention may be formed by a foil of stainless steel or copper.

Moreover, the heat-resistant resin for the heating roller for fixation according to the invention is formed by any one of polyether sulfone, polyphenylene sulfide, and polyether ether ketone.

As described above, in the heating roller for fixation according to the invention, the resistance heating element member may be formed by a heat-resistant resin sheet externally formed with a heater. The heat-resistant resin sheet is integrally fixed to the roller on its inner circumferential surface by blow-molding another heat-resistant resin. This novel structure allows the roller to be easily fabricated by a simple process.

Further, in the heating roller for fixation according to the invention, the resistance heating element member is formed by a cylindrical heat-resistant resin externally formed with a heater, and further externally formed with an insulating layer. The resistance heating element member thus formed is integrally fixed inside the roller by blow-molding. This novel setup also allows the roller to be fabricated by a simple process.

Still further, in the heating roller for fixation according to the invention, the heater is formed by a belt-shaped resistor member that meanders in a predetermined pattern, both ends of the roller being provided with an electrode formed by the same material as the resistor member, the electrode being arranged so as to be continuous with the resistor member. This novel structure allows the roller to be heated substantially in its entirety. The meandering pattern may be designed with ease such that the roller is heated higher toward both ends or heat distributions on both ends or the center portion of the roller are changed freely. Since the electrodes are formed to continue on the resistor member, the resistor member and the electrodes may be formed integrally. This novel structure eliminates the necessity for separately providing a separate ring-shaped electrode for connection to the resistor member and provides a good electrical contact between the resistor member and the electrodes.

Yet further, in the heating roller for fixation according to the invention, the resistor member may be formed by a foil of stainless steel or copper. This novel structure allows the roller to be easily fabricated by etching or like process and provides the roller of light weight and excellent durability.

Moreover, for the material of the above-mentioned heat-resistant resin, it is desirable to use any one of polyether sulfone, polyphenylene sulfide, and polyether ether ketone.

BRIEF DESCRIPTION OF THE DRAWINGS

Preferred embodiments of the present invention will be described in detail with reference to the following figures wherein.

DESCRIPTION OF PREFERRED EMBODIMENTS

The invention will be described in further detail by way of example with reference to the accompanying drawings.

The following description will be made with respect to a heating roller for fixation practiced as one preferred embodiment of the present invention, the heating roller being assembled in a fixating assembly disposed in image recording devices such as a copier and a printer.

Figure 1:
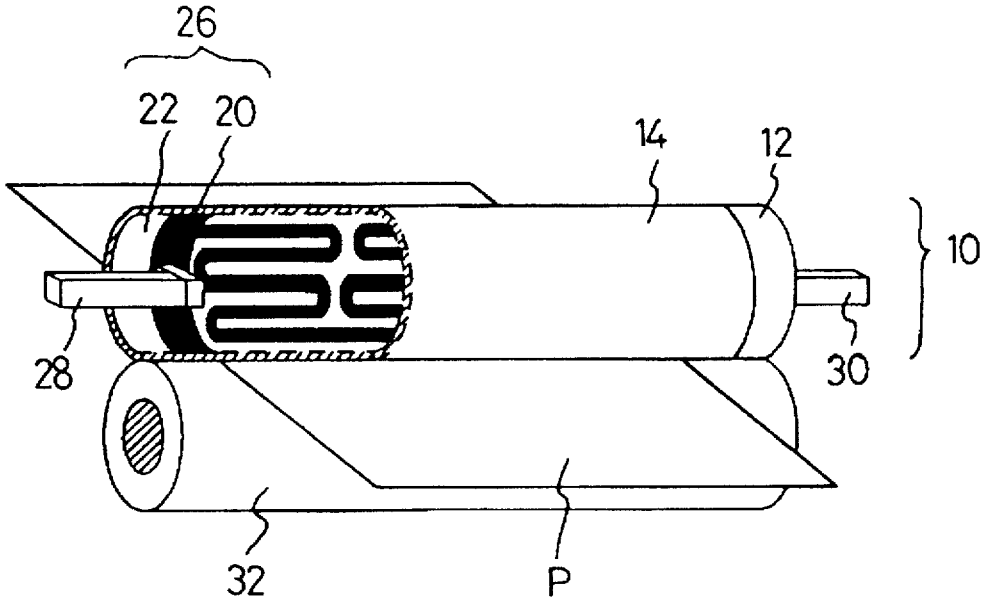
FIG. 1 is a schematic diagram illustrating a heating roller for fixation and its peripheral members according to one preferred embodiment of the invention.
Figure 2:
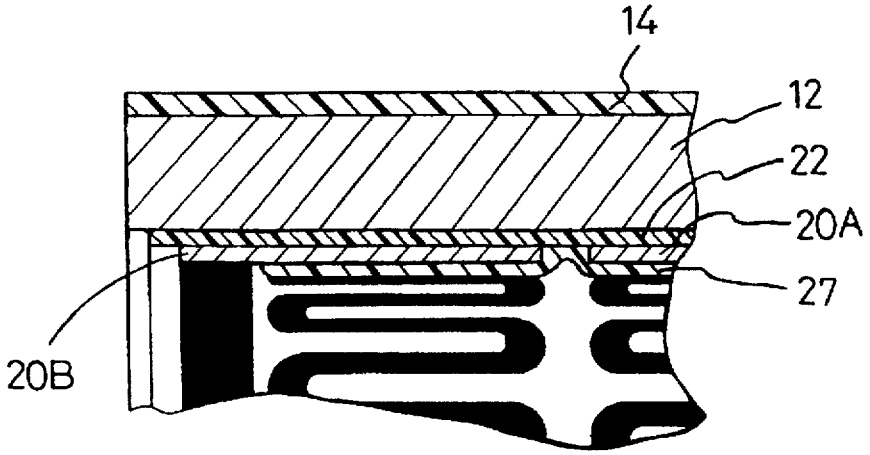
FIG. 2 is diagram illustrating a partial cross section of the heating roller of FIG. 1 along its length.

Now, referring to FIGS. 1 and 2, a heating roller 10 for fixation is a drum made of aluminum, for example. A roller body 12 with good heat conductivity is externally circumferentially formed with a deposit prevention layer 14 and internally circumferentially inserted with a resistance heating element member 26 (FIG. 3) made of a heat-resistant resin sheet 22 formed with a resistance heating element 20. The resistance heating element member 26 is, in this position, bonded to the roller body 12 by blow-molding with an expandable pressing member or a cylindrical heat-resistant resin member 27 (FIG. 2).

The deposit prevention layer 14 is excellent in heat resistance, being formed by fluororesin, such as a Teflon coat, and has a thickness of about 10 to 20 μm. The deposit prevention layer 14 prevents toner from adhering to a recording medium P during the toner fixating process.

As shown in FIG. 1, the heating roller 10 for fixation is pressed against a rubber press roller 32 and pivotally supported by a main frame by means of a pivot support (not shown). The heating roller 10 fixes toner attached to a recording medium P fed between the roller 10 and the press roller 32 while pressing and heating the toner.

Figure 3:
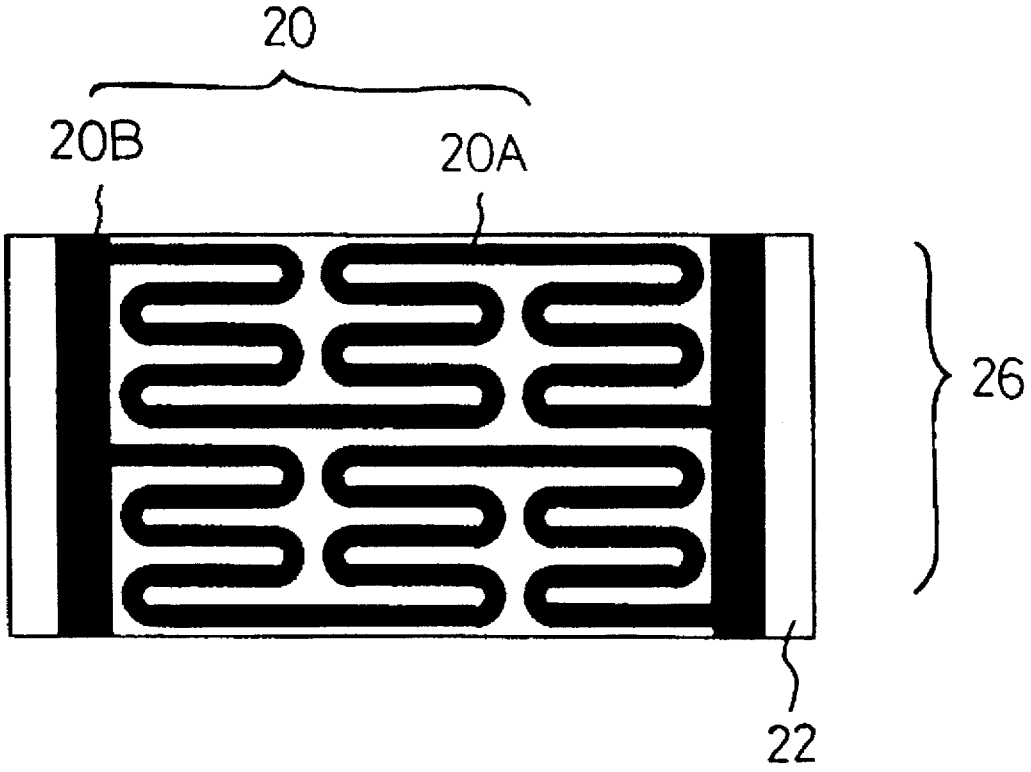
FIG. 3 is a diagram illustrating one construction of a heat generating sheet for use on the heating roller of FIG. 1.

As shown in FIG. 3, the resistance heating element member 26 includes the heat-resistant resin sheet 22 made of a polyimide sheet and the resistance heating element 20 having a thickness of 30 to 50 μm and formed by meandering in a predetermined pattern a belt-shaped resistor member 20A made, for example, of two belt-shaped stainless steel foils.

The resistance heating element 20 is formed with an electrode 20B on each of the left and right sides thereof corresponding to the left and right sides of the resistor member 20A.

As shown in FIG. 1, a pair of slide electrodes 28 and 30 each having a brush at a tip thereof are supported by the main frame (not shown). The brushes are in contact with electrodes 20B of the heating roller 10. The resistor members 20A are heated by a drive current supplied through the slide electrodes 28, 30 to heat the heating roller 10 in its entirety.

Meanwhile, the fabrication of the resistance heating element member 26 will be described briefly. First, a stainless steel foil sheet is bonded on the heat-resistant resin sheet 22. A resist or mask is applied, by screen printing, onto the bonded stainless steel foil sheet in the predetermined meandering pattern and electrode pattern on the left and right ends of the heat-resistant resin sheet 22. Then, the resist or mask is removed after etching to form the heat generating sheet. The resistor member 20A and the electrodes 20B connected to both ends of the resistor member 20A are simultaneously formed on the heat generating sheet.

Subsequently, the resistance heating element member 26 is inserted in the aluminum drum to be blow-molded with the heat-resistant resin member 27 from inside the aluminum drum, being fixed inside the roller body 12. For the heat-resistant resin member 27, polyether sulfone, polyphenylene sulfide, or polyether ether ketone is preferably used. For example, if polyether sulfone is used, it is desirable to heat it up to 300° to 330° C. at an air pressure of 3 to 5 kg/cm$^2$.

Because the resistance heating element member 26 is already formed on both sides with the electrodes 20B by the resistance heating element 20, it is not necessary to provide an additional current carrying member, such as a ring-shaped metal electrode.

In what follows, the heating operation of the heating roller 10 will be described.

Figure 4:
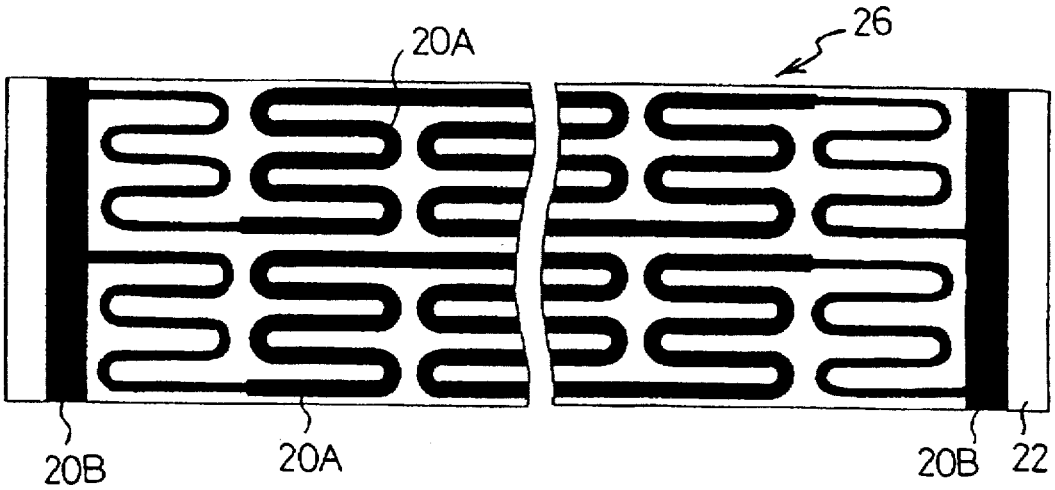
FIG. 4 illustrates a heating roller according to another embodiment of the invention.

A drive current provided to the slide electrodes 28 and 30 on the left and right sides is supplied to the resistor member 20A to heat the same. A width of the resistance lines on the left and right sides of the resistor member 20A is designed to be narrower than that in the center portion, so that the left and right sides are heated higher than the center portion, as shown in FIG. 4. This arrangement prevents the heating temperature of the heating roller 10, especially that in the left and right portions thereof, from decreasing, thereby maintaining a substantially uniform temperature distribution over the entire heating roller for fixation 10.

The heat generated by the resistance heating element 20 is transmitted to the deposit prevention layer 14 through the heat-resistant resin sheet 22 and the roller body 12. The heat generated by the resistance heating element member 26 provides a more uniform heat distribution by means of the roller body 12. The toner attached to the recording medium P fed between the heating roller for fixation 10 and the press roller 32 is fixed by the generation of heat.

Figure 6:
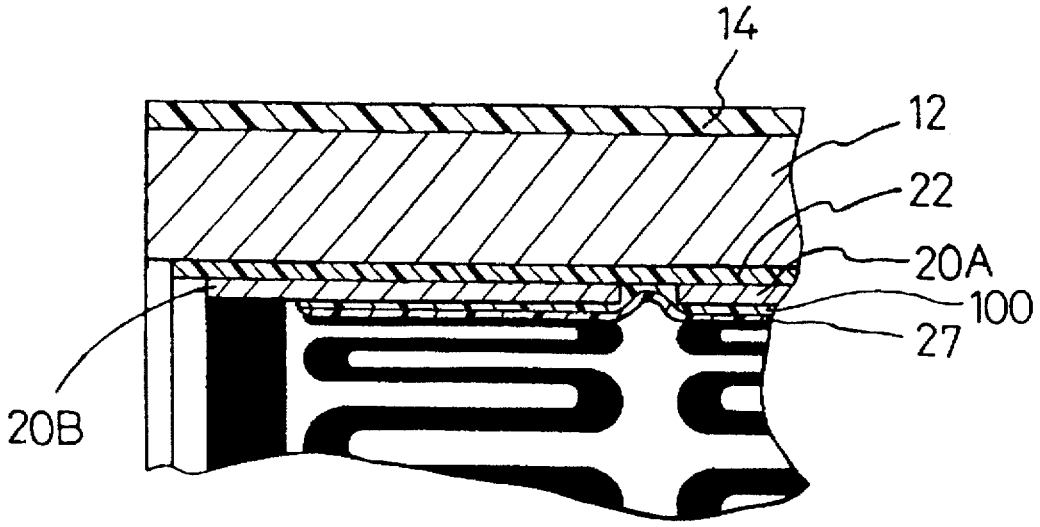
FIG. 6 illustrates another modification of an embodiment according to the present invention.

It will be apparent to those skilled in the art that a copper foil may be used for the resistance heating element member 26 instead of the stainless steel foil used in the present embodiment. When the copper foil is used, a power supply member for supplying power to the resistance heating element can be easily installed because copper is easily soldered. However, copper is lower in resistance than stainless steel, so that the etching pattern formed by copper must be made narrower than that of stainless steel. Further, the resistance heating element 20 of copper is preferably coated over with a polyimide film or the like 100 (FIG. 6) because copper is oxidized more easily than stainless steel. Besides, if necessary, the resistance heating element 20 may be formed by other metals including iron.

It will also be apparent to those skilled in the art that the two belt-shaped meandering patterns of the resistor member 20A of the present embodiment may be one belt shaped pattern, or three or more belt-shaped patterns. See FIG. 4, for example. According to a resistance value of the resistance heating element 20 and a substantially proper distribution of heat generation of the resistor member 20A, suitable patterns may be formed easily.

Figure 5A:
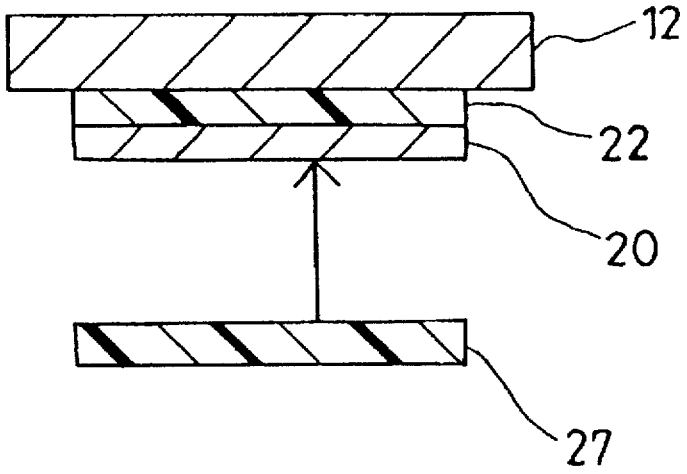
FIGS. 5A and 5B schematically illustrate two examples of blow-molding processes according to the present invention.
Figure 5B:
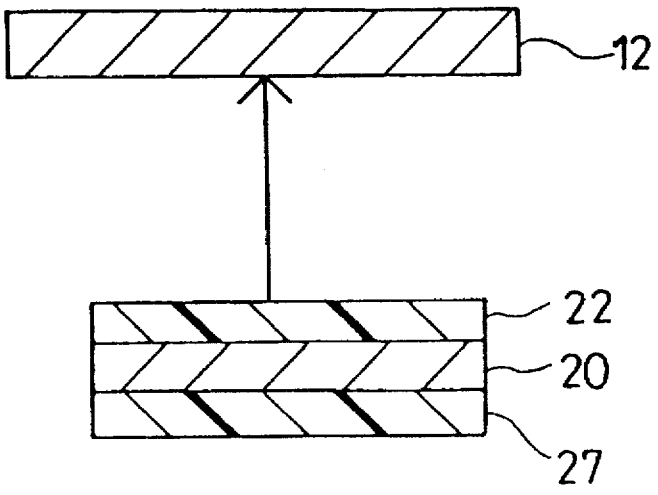

In the present embodiment, the stainless steel heater pattern is formed on the polyimide sheet 22 to provide the resistance heating element, which is bonded inside the heating roller by blow-molding with the heat-resistant resin member 27 (FIG. 5A). It will also be apparent to those skilled in the art that the heater pattern may be formed directly on the heat-resistant resin member 27 and then the member formed with the resin sheet or insulating layer 22 may be bonded inside the aluminum drum by blow-molding (FIG. 5B).

In the present embodiment, polyether sulfone, polyphenylene sulfide or polyether ether ketone is used for the heat-resistant resin member 27. It will be apparent to those skilled in the art that basically any material can be used so long as a linear expansion coefficient of the heat-resistant resin member 27 is smaller than that of the roller body 12. This is because, when the temperature lowers after the blow-molding, both the roller body 12 and the heat-resistant resin member 27 shrink a little; if the linear expansion coefficient of the roller body 12 located outside is larger than that of the heat-resistant resin member 27, the roller body 12 shrinks to a greater extent, bonding to the heat-resistant resin member 27 more tightly.

Alterations and variations may be made to the above-described preferred embodiments of the invention based on technologies known or obvious to those skilled in the art within the scope of the technological concept of the invention. Also, it will be apparent that the present invention is applicable to any other heating rollers for fixation having a roller body and a resistance heating element member.

What is claimed is:

1. A heating roller for heating and fixing toner attached to a recording medium, comprising:

a cylindrical roller having an inner surface;

a heat-resistant resin sheet arranged inside said cylindrical roller;

a resistance heating element formed on said heat-resistant resin sheet at one side thereof; and an expandable pressing member for fixing said heat-resistant resin sheet and said resistance heating element integrally onto the inner surface of said cylindrical roller.

2. The heating roller as claimed in claim 1, wherein said expandable pressing member is made of a heated material that maintains a pressing force even after the material cools down.

3. The heating roller as claimed in claim 1, wherein said expandable pressing member is a blow-molded heat-resistant resin member for fixing said heat-resistant resin sheet and said resistance heating element integrally onto the inner surface of said cylindrical roller.

4. The heating roller as claimed in claim 3, wherein said blow-molded heat-resistant resin member is made of a material selected from the group consisting of polyether sulfone, polyphenylene sulfide, and polyether ether ketone.

5. The heating roller as claimed in claim 1, wherein a linear expansion coefficient of said cylindrical roller is greater than that of said expandable pressing member.

6. The heating roller as claimed in claim 1, wherein said expandable pressing member includes an external circumferential surface in contact with said resistance heating element, said resistance heating element being further formed with an insulating layer thereon.

7. The heating roller as claimed in claim 1, wherein said resistance heating element includes a belt-shaped resistance heating element that is formed in a predetermined pattern, said belt-shaped resistance heating element including a left portion, a right portion and a center portion, said left portion and said right portion having a width less than a width of said center portion, and said heating roller is arranged on each end thereof with an electrode formed by the same material as said belt-shaped resistance heating element so as to be continuous with said belt-shaped resistance heating element.

8. The heating roller as claimed in claim 1, wherein said resistance heating element comprises a stainless steel foil.

9. The heating roller as claimed in claim 1, wherein said resistance heating element comprises a copper foil.

10. The heating roller as claimed in claim 9, wherein said copper foil includes a protective anti-oxidation film.

11. A process for fabricating a heatable toner fixing roller comprising:

forming a laminate including a resistance heating element and a pair of associated electrodes;

positioning the laminate within an inner surface of the fixing roller; and expanding the laminate using a force directed radially outward to establish and maintain firm contact between the inner surface of the fixing roller and the laminate.

12. A process according to claim 11, wherein said forming step includes forming said laminate on a first heat-resistant resin sheet initially in loose contact with the inner surface of the heating roller, and an expandable pressing member comprises a second heat-resistant resin sheet that is expanded to establish and maintain firm contact between the inner surface of the heating roller and the first heat-resistant resin sheet.

13. A process according to claim 11, wherein the expanding step includes inserting an expandable pressing member within the roller, and blow-molding the expandable pressing member to establish and maintain said firm contact.

14. A process according to claim 13, further comprising an insulating sheet covering the laminate, and both the expandable pressing member and the insulating sheet are blow-molded.

15. A method of fabricating a heating roller for heating and fixing toner attached to a recording medium, comprising:

forming a resistance heating element for supplying heat necessary for toner fixation and an electrode connected to each end of the resistance heating element on a surface of an expandable, pressing member;

forming an insulating layer on the surface of said expandable pressing member arranged with said resistance heating element and each said electrode;

inserting said expandable pressing member formed with said insulating layer inside of said heating roller for fixation; and expanding the expandable pressing member under heat to fix said expandable pressing member to said heating roller for fixation on an inner circumferential surface of the heating roller.

16. A method of fabricating a heating roller for heating and fixing toner attached to a recording medium, comprising:

forming a resistance heating element for supplying heat necessary for toner fixation and forming an electrode connected to each end of the resistance heating element on one side of a heat-resistant resin sheet;

inserting said heat-resistant resin sheet arranged with said resistance heating element and said electrodes into said heating roller;

inserting an expandable pressing member inside said heat-resistant resin sheet inserted in said heating roller; and expanding the expandable pressing member under heat to fix said heat-resistant resin sheet to said heating roller on an inner circumferential surface of the heating roller substantially without an adhesive agent.

17. The method of claim 16, wherein the expandable pressing member is an integral part of the heating roller.

* * * * *